United States Patent [19]

Slanik

[11] 3,959,055

[45] May 25, 1976

[54] TEXTILE APPARATUS AND PROCESS

[75] Inventor: Josef Milan Slanik, Montreal, Canada

[73] Assignee: The Bobtex Corporation Limited, Montreal, Canada

[22] Filed: Oct. 21, 1974

[21] Appl. No.: 516,390

[30] Foreign Application Priority Data

Oct. 23, 1973 United Kingdom ..... 49376/73

[52] U.S. Cl. ..... 156/167; 57/35; 156/244; 156/433; 156/543; 226/91

[51] Int. Cl.[2] ..... G03B 1/56; D02G 3/00

[58] Field of Search ..... 156/167, 176, 433, 436, 156/244, 296, 301, 500, 543, 184, 484; 226/2, 3, 91, 92, 184, 152, 168, 200; 57/164, 144, 152, 34, 35; 425/DIG. 2; 264/176 R, 176 F, 103; 242/27, 27.1, 172, 18 PW, 45; 117/102 A

[56] References Cited

UNITED STATES PATENTS

| | | | |
|---|---|---|---|
| 2,736,056 | 2/1956 | Joulmin, Jr. | 425/DIG. 2 |
| 3,298,621 | 1/1967 | McCoy | 242/18 A |
| 3,548,581 | 12/1970 | Bobkowicz et al. | 57/164 |
| 3,632,374 | 1/1972 | Greillen | 117/120 |
| 3,771,701 | 11/1973 | Brunk et al. | 226/91 |
| 3,819,123 | 6/1974 | Luz | 242/18 PW |
| 3,844,097 | 10/1974 | Bobkowicz et al. | 264/103 |

*Primary Examiner*—William A. Powell
*Assistant Examiner*—Michael W. Ball
*Attorney, Agent, or Firm*—Robert J. Shaap; Ian Fincham

[57] ABSTRACT

In an apparatus and method suitable for the manufacture of composite yarns wherein a filament is introduced between two rotatable rollers, there is provided the improvement of a start-up means adapted to automatically introduce the filament between the two rollers, at least one of which has a further source of yarn-forming material thereon. In the apparatus and method of the invention, greater reliability and a decrease in downtime are achieved.

14 Claims, 4 Drawing Figures

TEXTILE APPARATUS AND PROCESS

This invention relates to a method and apparatus and more particularly, this invention relates to an improvement in an apparatus and method, which apparatus and method are suitable for the manufacture of composite yarns.

The manufacture of yarns in the textile field is a well known art and has been practiced for many years. Recently however, there have been some basic and new advances in the art relating to the formation of composite and/or multi-component yarns; these composite yarns comprising a substrate of an interfiber binding material, such as a polymeric substance, with the inter-fiber binding material having a yarn forming material at least partially embedded therein. The yarn-forming material may comprise any suitable such as fibrids or staple length fibers. These new improvements have allowed the "engineering" of specific and desirable properties into the composite yarn being manufactured and permitted production speeds at heretofore unobtainable rates to be employed. Such yarns and the method and apparatuses for producing the same have been described in, among others, Canadian Pat. No. 833,443 issued Feb. 3, 1970 and Canadian Pat. No. 880,988 issued Sept. 14, 1971.

A further advance in the apparatus and method for producing such yarns is described in U.S. copending application Ser. No. 515,407. In this application, a method and apparatus and new product are described with respect to the production of composite yarns using separate fiber sources for forming two separate particulate fibers which are then placed in juxtaposition with a source of inter-fiber binding material.

In the above-referred to specifications, a filament or strand of inter-fiber binding material is placed in juxtaposition with at least one source of particulated yarn-forming material and passed between a pair of spaced-apart rotatable rollers. When operational, these apparatuses have been found capable of producing novel yarns at great production speeds. However, a problem associated with these apparatuses relates to the introduction of the strand or filament of inter-fiber binding material between the pair of spaced-apart rotatable rollers.

In starting up the above-referred to apparatus, according to techniques previously employed, manual threading of the strands of inter-fiber binding material between the pair of rotatable rollers had to be employed. These rollers are mounted in close proximity to each other, often with as little as 1/50,000th of an inch gap therebetween. In starting up the apparatus, according to conventional techniques, it is necessary to bring the machine up to operating speed by stepping up the rotational speed of the respective drums or rollers, together with the speed of extrusion of the inter-fiber binding material from suitable extrusion means — i.e. an extrusion die.

The above problems meant that before the apparatuses got to full operational speed (in which the composite yarn may be produced at rates of in excess of 2,000 feet per minute), there is a fair amount of loss of material until such time as both of the inter-fiber binding material and the source of yarnforming material were threaded at the desired rates to produce a yarn of the desired composition. This problem is further accentuated by the fact that a typical inter-fiber binding material, such as a polymeric material, cannot be held in an extrusion die per se for any length of time, so that on shutdowns, scrap material was produced which had to be removed from the system before start-up could be initiated. Also, it was difficult to tie in the output rates of the extruder die with the rates of the yarn-forming material in terms of varying one with respect to the other.

Additionally, often one extruder die is used to supply a plurality of strands or filaments when the apparatus is equipped to handle many such operations. As will be obvious, the breaking of one strand of inter-fiber binding material would necessitate shutting down the entire operation until such time as the strand or filament can be manually threaded between the pair of rotatable rollers. This of course leads to increased down-time and reliability problems.

It is therefore an object of this invention to provide for an apparatus overcoming the above problems in that the apparatus includes means for automatically threading a strand or filament of inter-fiber binding material between two spaced-apart rotatable rollers.

It is a further object of this invention to provide for a method of introducing a strand of inter-fiber binding material between two spaced-apart rotatable rollers.

A still further object of this invention is to provide for an apparatus suitable for the manufacture of composite yarns, the apparatus including a start-up means for automatically threading a strand or filament of inter-fiber binding material between two spaced-apart rollers while these rollers are rotating at their operational speed.

Even further, an object of this invention, is to provide for a method of introducing, at similar speed, a strand or filament of inter-fiber binding material between two spaced-apart rotating rollers, one of which has a source of yarn-forming material thereupon, the method of the invention being suitable for accomplishing this while the rollers are rotating at operational speed.

A still further object of the present invention is to provide an apparatus suitable for the manufacture of composite yarns wherein the amount of waste material is minimized and means are provided for the collection of any such waste material.

Generally, according to the apparatus aspect of this invention, in an apparatus suitable for the manufacture of composite yarns, including at least a pair of spaced-apart rotatable rollers with one of the rollers having a collecting means thereupon, and extrusion means adapted to extrude at least one filament of inter-fiber binding material mounted on one side to the rotatable rollers, there are provided for start-up means comprising a rotatable start-up roller, said start-up roller being mounted on a side of the pair of rotatable rollers opposed to the side on which the extrusion means are mounted, said start-up roller having a portion of its circumference larger than a further portion of its circumference said further circumferential portion adapted to receive a leading edge of a filament extruded from the extrusion means including means for rotating said start-up roller such that said filament is wound thereupon from said further circumferential portion to said larger circumferential portion, said start-up roller being located such that on passing from the circumferential portion to the larger circumferential portion said filament will pass between the pair of spaced-apart rotatable rollers and contact the yarn forming material thereupon.

According to one aspect of the method of the present invention, there is provided for a method suitable for the introduction of a filament or strand of inter-fiber binding material in a composite yarn-forming apparatus having at least two spaced-apart rotatable rollers, one of which has a collecting means for forming a layer of yarn-forming material, the method comprising the steps of providing an extrusion means adapted to extrude at least one filament of inter-fiber binding material, mounting said extrusion means on one side of the two spaced-apart rotatable rollers, providing a start-up roller, on a side of said two spaced-apart rollers opposed to the side on which said extrusion means are mounted said start-up roller having a portion of its circumference larger than a further circumferential portion, extruding a filament of inter-fiber binding material from the extrusion means, placing a leading edge of said filament on said further circumferential portion, rotating said start-up roller, allowing said filament to wind upon said start-up roller from said further circumferential portion to said larger circumferential portion, said start-up roller being located such that said filament will pass between the two spaced-apart rotatable rollers and contact the layer of yarn-forming material upon passing from said further circumferential portion to said larger circumferential portion, and cutting said filament when the filament contacts the yarn-forming material.

In greater detail, and according to one aspect of the apparatus of the present invention, there are provided for at least two opposed spaced-apart rotatable rollers, at least one of the rollers having a collecting means thereon adapted to receive a layer of fibrous yarn-forming material. Conventionally, the collecting means transport the yarn-forming material from a source of the same to the nip of the rollers as will be discussed in greater detail; such an apparatus is shown in Canadian Pat. No. 880,988 issued to Emilian Bobkowicz and Andrew J. Bobkowicz on Sept. 14, 1971.

As shown in the above referred to patent, suitable means for supplying a source of inter-fiber binding material are employed. Said means may be any which are suitable and well known to those skilled in the art, thus, for example, an extrusion die adapted to extrude one or more filaments of inter-fiber binding material such as a polymeric material, may be utilized. Such a source of inter-fiber binding material is mounted on one side of the pair of opposed spaced-apart rotatable rollers in a manner which will be discussed more fully hereinafter.

According to the apparatus aspect of the present invention, there are provided for start-up means, such start-up means, as mentioned above, comprising means of introducing a strand or filament of inter-fiber binding material between at least a pair of spaced-apart rotatable rollers in such a manner so as to place the strand or filament into juxtaposition with fibrous yarn-forming materials carried by collecting means on at least one of said rollers. To this end, there is provided a start-up roller having at least one larger circumferential portion and at least one smaller circumferential portion and including means for securing a leading edge of the strand or filament of inter-fiber binding material to the smaller circumferential portion of the start-up roller. The apparatus also includes further means for rotating the start-up roller whereby the strand or filament of inter-fiber binding material winds itself on the start-up roller from the smaller circumferential portion to the larger circumferential portion. The start-up roller is positioned such that, as the strand winds itself upon the start-up roller from the smaller portion to the larger portion, it will pass between the two spaced-apart rollers and be placed in juxtaposition to the collecting means on one of the rollers. In this respect, the term "side" is employed in the sense that the axis of two spaced-apart rollers may be considered to be a first plane while the strand extending between the extrusion means and start-up roller is in a second plane, which may be, although not necessarily so, substantially perpendicular to the first plane.

The start-up roller may be of a regular or irregular configuration. In other words the start-up roller may have a substantially regular rate of taper so as to be substantially of a frusto-conical configuration. On the other hand, any suitable roller having at least one smaller circumferential portion and at least one larger circumferential portion may be employed in the present invention. Thus, a roller having a portion of a cylindrical configuration adjoining an outwardly tapering shoulder portion may be employed with suitable placement of the start-up roller.

Drive means adapted to rotate the start-up roller may be any drive means suitable and need not be discussed herein. It suffices to say that the start-up roller may be journalled on a suitable shaft and the drive means may comprise separate means apart from the drive means utilized for the other components of the apparatus. However, the drive means may form an integral part of further drive means employed in the apparatus.

During the "start-up" of the apparatus, a leading edge of the strand of inter-fiber binding material extruded from the source thereof, is placed on the smaller circumferential portion of the start-up roller whereby the strand or filament proceeds to wind itself upon the surface of said roller and passes from the smaller circumferential portion to the larger portion.

According to one aspect of the present invention there may be provided for means of attaching the strand of inter-fiber binding material to the smaller circumferential portion.

The preferred attaching means according to the present invention are particularly suitable wherein the smaller circumferential portion of the start-up roller is located at one end thereof. In this embodiment, a plate-like member may be secured to the end of the start-up roller having the narrower circumferential portion. Preferably, the plate-like member is at least equal to or slightly larger in diameter than the end of the roller whereby a flange extending beyond the start-up roller is formed.

In a preferred embodiment, the plate-like member comprises a substantially circular plate attached to the narrower end of the start-up roller in such a manner so as to leave a slight space between the plate and the roller. Means of attaching the plate to the start-up roller may be any conventional means — e.g. mechanical means.

Preferably, the plate is of a somewhat flexible nature whereby the outer circumferential edges of the plate may be flexed so as to place the strand or filament of inter-fiber binding material between the plate and the end of the start-up roller. To this end, the plate may be constructed of materials such as rubber, plastic, etc.

In the apparatus aspect of the present invention, there is provided for cutting means adapted to sever or cut the strand or filament of inter-fiber binding material once such a strand has been placed in juxtaposition to the layer of fibrous yarn-forming material carried by the collecting means on one of the rotatable rollers. Such cutting means will be positioned in relationship to the strand of inter-fiber binding material so as to automatically cut the same as will be more fully described hereinafter.

A further cutting means may be employed in an apparatus which employs a further auxiliary feeding means such as a suitable roll of flexible yarn, rope, or the like material. Such further cutting means may be automatically actuated to sever the leader material once its function has been accomplished.

According to a still further aspect of the present invention, there may be provided for air jet means which are adapted to divert the extrudate of inter-fiber binding material to a disposal system when such inter-fiber binding material is not required. In other words, when the apparatus is not operational, and as mentioned above, the inter-fiber binding material cannot be held in the extrusion means for any length of time. Therefore, there may be provided for means whereby the extrudate of inter-fiber binding material, which is continually extruded, to be diverted to a suitable disposal system.

In a preferred embodiment, as an aid to the start-up of the apparatus using the method of this invention, an air jet or air gun means which are well known in the art, may be employed. Typically, the air gun or jet will include an inlet connected to a pressurized source of air, a nozzle with a venturi therein, with the nozzle being connected to an air discharge conduit. The nozzle or other like conduit will thus have a vacuum and by the use of a control valve or the like, the pressurized air escaping through the nozzle will create a vacuum in the device. This vacuum can thus be used to control the leading edge of the material used in the start-up operation and the use of the gun will permit this leading edge to be threaded to the start-up roller.

According to one aspect of the method of the present invention, there is provided for a method suitable for introducing a strand of inter-fiber binding material into juxtaposition with yarn forming material on collecting means of a rotating roller which is in a spaced-apart relationship to a second rotating roller. In this aspect, there are provided for the steps of providing a start-up roller having at least one larger circumferential portion and at least one smaller circumferential portion, attaching a leading edge of the strand of inter-fiber binding material to the smaller circumferential portion, rotating the start-up roller so that said attached strand will pass between said opposed spaced-apart rollers and be placed in juxtaposition to the collecting means.

Although many relationships obvious to those skilled in the art upon a reading hereof may be utilized, reference herein will be made to an apparatus having a pair of spaced-apart rotatable rollers with the plane passing through their axis being a substantially horizontal plane. Likewise, reference will be made to the extrusion means as being mounted above the opposed rollers. This is for purposes of explanation only and it is understood that any spatial relationship adapted to achieve the desired results may be employed.

As previously discussed, the extrusion means usually comprises an extrusion die capable of extruding one or more filaments of inter-fiber binding material. Conventionally, the extrusion means are mounted above the opposed rollers. In this embodiment, the start-up roller would then be mounted below the opposed rollers or, in other words, on the side opposed to the extrusion means.

The start-up roller is located in such a manner that a straight line followed by the strand from the source of inter-fiber binding material to the narrower circumferential portion does not touch either of the opposed rollers. The path which the strand follows, upon a winding of the same on the start-up roller, will pass between the gap between the spaced-apart rollers and then proximate to the collection means. At all times, the strand of inter-fiber binding material is in a straight line configuration and is tangential to the start-up roller. The degree of taper of the start-up roller and the location thereof may be easily adjusted according to the above requirements.

Having thus generally described the invention, reference will be made to the accompanying drawings illustrating a preferred embodiment thereof and in which.

Figure 1:
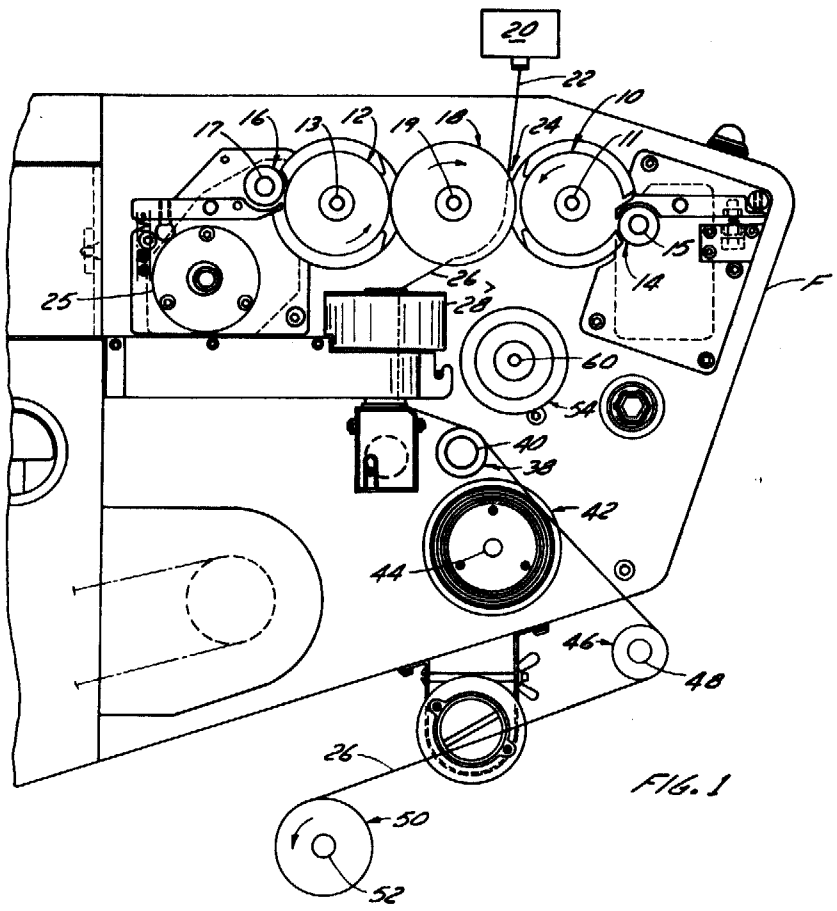
FIG. 1 is a side elevational view of a composite yarn-forming apparatus.

Referring to the drawings and by reference characters thereto, FIG. 1 illustrates a typical composite yarn-forming apparatus in a side view, wherein a first source of yarn-forming material (not shown) is fed into the apparatus and is subjected to a particulating step to form staple length fibers. Roller 14 which is journalled on a suitable shaft 15 is adapted to perform this particulating step in co-operation with an advancing roller 10. Advancing roller 10, journalled on shaft 11 rotates in the direction shown by the arrow and is adapted to receive the particulated fibrous matter from roller 14. In this respect, reference may be had to British Pat. No. 43875/73 showing the method of operation of rollers 10 and 14. Suitable means (not shown) are provided for rotating rollers 10 and 14 in a manner well known to thos skilled in this art. The means of rotation may be adapted to rotate rollers 10 and 14 at similar linear rotational velocities or at different linear rotational velocities.

In the illustrated embodiments, means (not shown) are available for providing a second source of yarn-forming material. In a manner similar to that above described, the second yarn-forming material is subjected to a particulating step by rollers 16 and 12 which are journalled on shafts 17 and 13 respectively. Likewise, suitable means are provided for rotating rollers 12 and 16 in the manner illustrated by the arrows. These means may be tied in with the means for rotating rollers 10 and 14.

Rollers 10 and 12 are, in the above described embodiment, adapted to deliver first and second sources of a particulated fibrous yarn-forming material to a further roller 18. Rollers 10 and 12 may be of any conventional construction and may be such as are shown in the above referred to Canadian Patents. To this end, rollers 10 and 12 may be needle, carding, or toothed rollers, delivery rollers, etc. Rollers 10 and 12 function so as to deliver the particulated fibrous matter to roller 18 and as such, may be called "delivery rollers".

Roller 18, journalled on shaft 19, is intermediate of delivery rollers 10 and 12 and is mounted in a slightly spaced-apart relationship with respect to rollers 10 and 12 as will be discussed in greater detail hereinafter. Conventional means for rotating roller 18 are provided and again, these means may rotate roller 18 at a velocity tied in with the velocity of rollers 10 and 12. In the Figures, all frame members are designated by reference character F.

Figure 3:
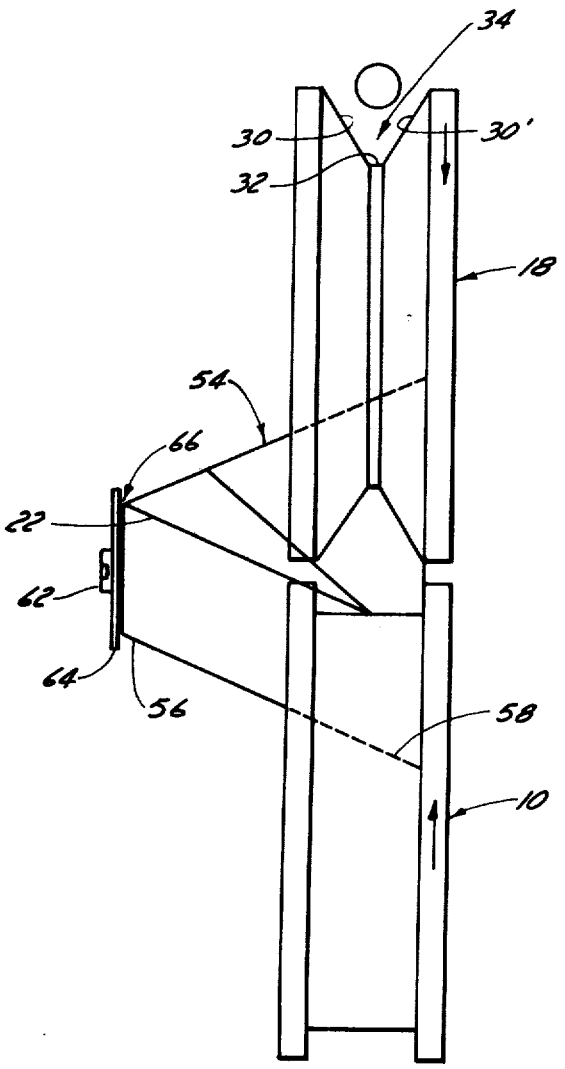
FIG. 3 is a top view illustrating the starter roller of the present invention.

Roller 18 preferably includes means for collecting and forming a layer of particulated fibrous material from delivery roller 12. Thus, as may be best illustrated by reference to FIG. 3 illustrating a top view of rollers 10 and 18, roller 18 has two inwardly inclined walls 30, 30' and a base 32 on the circumferential portion so as to have a somewhat V-shaped configuration thereon. This V-shaped trough 34 is adapted to receive the particulated matter from roller 16 and form a layer of staple length fibers thereon. Suitable means for retaining the staple length fibers in a layer on collecting trough 34 may comprise suction means (not shown) within roller 18 such as those shown in co-pending U.S. Pat. Ser. No. 515,407. Also, as illustrated in FIG. 3, there is a small gap (often as little as 1/50,000ths of an inch) between roller 18 and delivery roller 10.

Illustrated schematically in FIG. 1 are means supplying a source of inter-fiber binding material comprising an extrusion die 20 adapted to extrude a molten filament or strand 22 of an inter-fiber binding material, such as a polymeric material. In the embodiment illustrated, extrusion die 20 is shown extruding one strand, however in practice, extrusion die 20 may be adapted to extrude a plurality of inter-fiber binding material strands. Extrusion die 20 is adapted to extrude a strand 22 of inter-fiber binding material to the nip 24 of rollers 10 and 18. The inter-fiber binding material may be a polymeric material, and extrusion die 20 is adapted to deliver strand 22 to nip 24 in a somewhat tacky condition.

In the embodiment above described, a first source of particulated yarn-forming material is advanced on roller 10 to nip 24. A second source of particulated yarn-forming material is advanced from roller 12 and transferred to the collecting trough 34 of roller 18 by suitable means — e.g. suction means. The second particulated yarn-forming material forms a layer of the same on collecting trough 34 of roller 18 and is delivered to nip 24 of rollers 10 and 18. Strand 22 of inter-fiber binding material is then placed in juxtaposition to the first and second sources of yarn-forming material thus described. The particulated yarn-forming material is then partially embedded in strand 22 and a composite yarn is formed.

Composite yarn 26 is then "taken off" roller 18 and may be subjected to a number of further steps depending upon the final properties and type of yarn desired. Thus, as illustrated in FIG. 1, composite yarn 26 may be passed through a twisting device 28. Twisting device 28 may comprise false twisting means, friction twisting means, or the like. Such twisting means 28 are well known to those skilled in the art and need not be further described.

After emerging from the twisting means 28, composite yarn 26 passes over a guide roller 38 journalled on shaft 40. After passing over first guide roller 38, composite yarn 26 is then entrained about a further roller 42. The composite yarn 26 may be passed about roller 42 a plurality of times, the embodiment illustrating composite yarn 26 being entrained about roller 42 six times. Roller 42 is journalled on a shaft 44, and suitable means for rotating rollers 38 and 42 may be provided. Again, these means may be tied in with the means rotating the above described rollers.

After passing over roller 42, composite yarn 26 is taken off to a second guide roller 36 journalled on shaft 48. Composite yarn 26 then is wound up on winder-up roller 50 journalled on shaft 52.

Prior art techniques previously employed for the threading of strand 22 between rotating rollers 10 and 18 was a difficult task to accomplish due to the narrow gap between the rollers. The start-up means of the present invention comprising start-up roller 54 of the present invention have eliminated the manual threading of the strand 22 into juxtaposition with trough 24.

As best illustrated in FIGS. 1 and 3, there is provided a start-up roller 54 which, in the specific form shown, is of a frusto-conical configuration having a narrower end 56 and a wider base portion 58 mounted in a spaced-apart manner below advancing roller 10 and roller 18. Frusto-conical roller 54 is driven by suitable means; to this end, roller 54 is mounted on a shaft 60 and secured thereon by suitable means — i.e. bolt 62; shaft 60. Roller 54 is driven to suitable drive means (not shown). In one embodiment these drive means may be tied in with the over-all drive means employed for rollers 10, 12, 14, 16 and 18, whereby the peripheral speed at base portion 58 of start-up roller 54 is preferably equivalent to the peripheral speed of the collecting trough 34 of roller 18, plus or minus approximately 20 per cent. If desired, and according to one embodiment of the present invention, the drive means for the start-up roller 54 and at least roller 18 may be tied in or co-ordinated with pre-set gears so as to operate the apparatus at pre-set speeds of desired levels — i.e. start-up roller 54 in terms of the peripheral speed at the base 58 of the roller may be set to operate at one of several different speeds with the same peripheral rotational speed being encountered at the collecting trough 34 of roller 18. Typically, for example, pre-set gears may be employed to provide rotational speeds, as measured in output in feet per minute for the composite yarn, of 500 feet, 1,000 feet, 1,500 feet, and 2,000 feet per minute. These figures, of course, are arbitrary and any suitable gears providing the desired peripheral speed level may be employed. If desired, the device of the present invention can operate with variable speed drive for the start-up roller co-ordinated with the peripheral speed of collecting trough 34 of roller 18.

Start-up roller 54, as will be seen from the drawings, preferably includes a terminal plate or like member indicated generally by reference numeral 64, which provides a flange to narrower end 56 of start-up roller 54. A preferred embodiment is illustrated in FIG. 3, wherein plate 64 is slightly spaced from the narrower end 56 of start-up roller 54 whereby a slight gap 66 is provided therebetween. Preferably, plate 64 is of a flexible material.

The surface of start-up roller 54 is preferably of a substantially smooth planar nature and preferably is also of a rigid or hard nature so that the surface of the roller does not deleteriously affect the polymeric material when the latter is placed in juxtaposition with it.

It should be noted that the narrower end 56 of start-up roller 54 projects beyond the advancing rollers previously described, such that a strand of inter-fiber binding material extending between extrusion die 20 and narrower portion 45 in a straight line manner does not contact either delivery roller 10 or roller 18. As will readily be understood by those skilled in the art, the above-described geometry of the start-up roll and the tension in the polymeric strand will cause the strand to wind up start-up roller 54 to contact the yarn forming material on roller 18.

Figure 2:
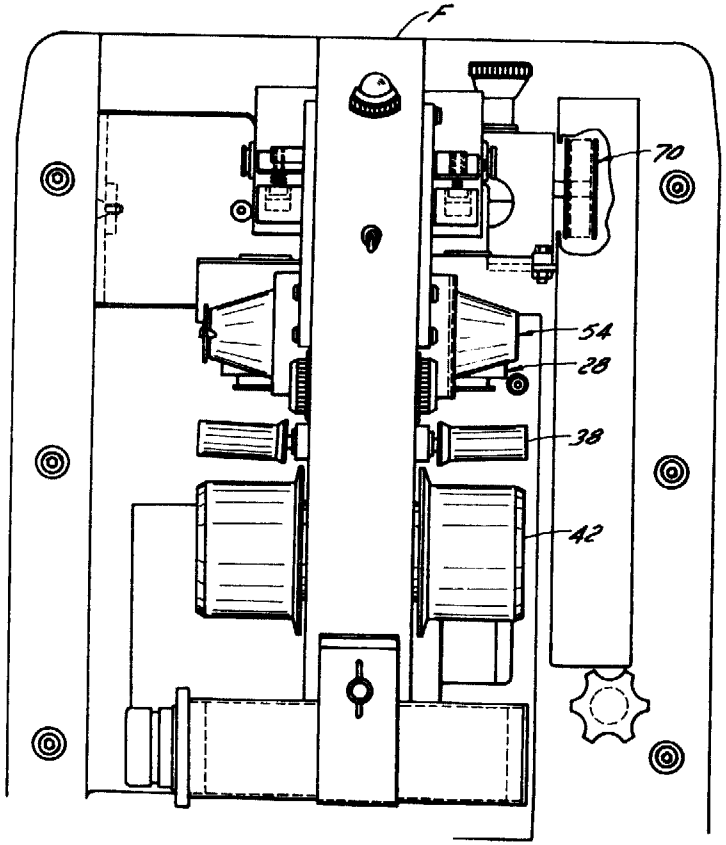
FIG. 2 is a front elevational view of the apparatus of FIG. 1.

Referring to FIG. 2 illustrating a front view of an apparatus according to the present invention, it may be noted that two identical yarn-forming operations may be carried on, one on each side of the apparatus. It may be seen, the source of yarn-forming material may be passed over a guide roller 70 from where it is fed to the further rollers for particulation as aforementioned.

Figure 4:
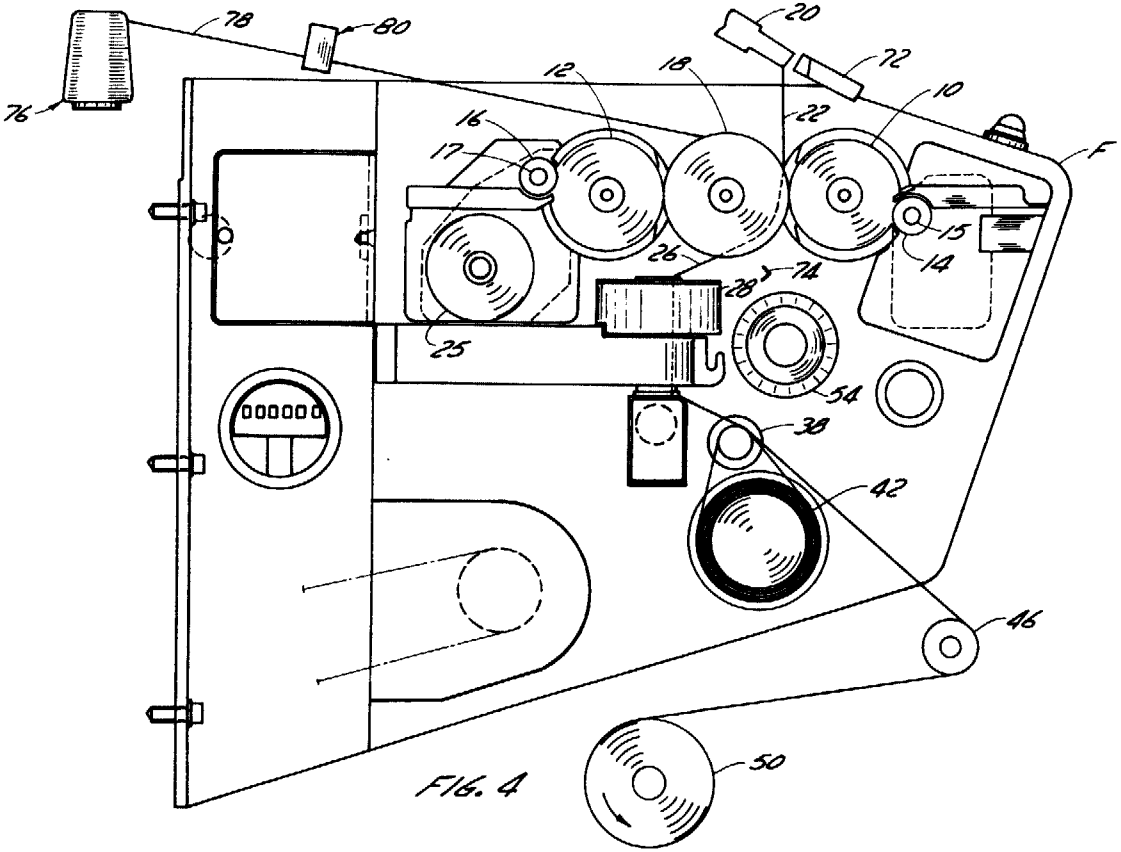
FIG. 4 is a perspective view of the yarn-forming and start-up rollers of the present invention.

FIG. 4 is illustrative of a further embodiment of the yarn-forming apparatus of the present invention. The view is similar to that of FIG. 1 and like reference numerals are employed for like components. Thus, all frame part are indicated generally by reference character F. As illustrated, there is provided for rollers 10, 12, 14, 16 and 18. Also shown in this diagram is cam 25. Likewise, the operation is similar to that shown in FIG. 1 wherein a strand or filament 22 of inter-fiber binding material from extrusion means 20 passes between rollers 10 and 18 in the described manner. The composite yarn 26 thus formed is passed through twisting means 28 from where the composite yarn passes over a guide roller 38. As may be seen, the composite yarn is further entrained about a roller 42 for a plurality of times from where it again passes over guide roller 38 and on to a further guide roller 46 to be wound up.

In this embodiment, wherein the extrusion means are shown schematically and indicated by reference numeral 20, there may be supplied a source of pressurized gaseous material about the extrusion means. Thus, the extrudate of inter-fiber binding material is extruded through a narrow nozzle which may be surrounded by a further conduit connected to a suitable source of pressurized gaseous material. When the apparatus is not operational, the pressurized gaseous material may be fed through the conduit and thus deflect or divert the extrudate into a disposal means or system. This is illustrated schematically in FIG. 4 wherein the extrudate may be diverted from extrusion means 20 to a collection system 72, also shown schematically.

In this manner, when the yarn-forming device is not operational, for any reason whatsoever, an even flow of inter-fiber binding material may be maintained at all times to prevent burning of the same, or degradation thereof, in the extruder and which scrap material would otherwise prevent the threading of the strand or filament of inter-fiber binding material between the two rotating rollers at full operational speed.

The apparatus may include, if desired and as an optional component, first cutting means designated generally by reference numeral 74 and indicated schematically in FIG. 4. Cutting means 74 are adapted to cut the strand or filament extending from the extrusion means 20 to start-up roller 54 when the filament has been placed in juxtaposition with the collecting trough on roller 18. Thus, after cutting, the filament 22 will then continue on the roller 18 and form a composite yarn with the one or more sources of yarn-forming material.

Still further, as a further embodiment of the present invention, auxiliary feeding means may be employed to aid in the starting-up operation and to this end, a suitable roll of flexible yarn, rope, or the like material may be utilized as generally indicated by reference numeral 76. This is preferably mounted on a suitable shaft to permit free pulling rotation of the roll; from the roll, a lead portion of the rope, yarn or like material, is fed over suitable guide means (not shown) and in to juxtaposition with the collecting trough 34 of roller 18. The leader 78 is preferably placed in juxtaposition with roller 18 prior to the polymeric strand 22 being placed in juxtaposition with the collecting trough. The function of the leader 78 is to permit the polymeric strand, when placed in juxtaposition with the leader, to provide a positive engagement or gripping means, once the polymeric filament or strand is properly positioned and the yarn-forming operation commenced. In this manner, once the yarn-forming operation has commenced, further cutting means 80 may be actuated to sever leader 78.

Both cutting means 74 and cutting means 80 may function as automatic cutting means as well known to those skilled in the art.

In accordance with the method of the present invention, the above-described yarn-forming apparatus may be started according to conventional starting techniques whereby rollers 10, 12, etc. are driven at a predetermined speed so as to give the desired composite yarn production speed. In a similar manner, start-up roller 54 is likewise actuated, and as indicated above, the peripheral rotational speed of base 58 is generally equal to the peripheral speed of the collecting surface of roller 18 ± 20%. In a like manner, the extruder means comprising extruder die 20 is actuated whereby strand 22 of interfiber binding material in a tacky condition is extruded. Strand 22 is fed down to start-up roller 54 and by means of gap 56 between plate 64 and narrower end 56 of start-up roller 54, the leading edge or starting portion of strand 22 is placed therebetween. The initial position of the strand, as just mentioned, is indicated by reference numeral 22' in FIG. 3. Thereafter, due to the rotation of start-up roller 54, and the position of extrusion die 20, strand 22' will "ride up" roller 54 and at a point between narrower portion 56 and base 58 the strand will be guided between the gap between rollers 10 and 18. Continued movement of the strand upwardly on the frusto-conical start-up roller 54 will bring the strand into alignment with the collecting trough 34 of roller 18 and in this position, strand 22 will contact the particulated yarn-forming material thereon.

According to the embodiment described with respect to FIG. 4 of the drawings, first cutting means 74 may be positioned so that when the filament 22 is in its final position relative to roller 18, the relationship of the cutting means 74 to filament 22 will automatically cut or sever the strand whereafter the resulting strand of interfiber binding material, being driven by roller 18, may be fed as a composite yarn to the twisting means 28. Furthermore, as mentioned above, further cutting means may be employed in the embodiment wherein a strand of leader material is employed.

From the above description, it will be seen that the apparatus of the present invention overcomes the problems related to prior art composite yarn-forming apparatus in the feeding or threading of a strand or filament of interfiber binding material between two spaced-apart rotatable rollers. Furthermore, a novel method has been provided for introducing a strand or filament of interfiber binding material between two spaced-apart rotatable rollers, one of which rotatable rollers has a source of yarn-forming material thereupon, the method of the present invention threading the strand while the rollers are rotating at operational speed.

It will be understood that various modifications may be made to the above-described embodiments without departing from the spirit and scope of the present invention, and that the above-described embodiments represent only preferred embodiments thereof.

I claim:

1. In an apparatus suitable for the manufacture of composite yarns including at least a pair of spaced-apart rotatable rollers with at least one of the rollers having collecting means for receiving a layer of yarn-forming material thereupon, and extrusion means adapted to supply at least one filament of inter-fiber binding material mounted on one side of the rotatable rollers, the improvement wherein the apparatus includes start-up means, said start-up means comprising a rotatable start-up roller, said start-up roller mounted on a side of said pair of rotatable rollers opposed to the side on which said extrusion means are mounted, said start-up roller having a portion of its circumference larger than a further circumferential portion, said further circumferential portion adapted to receive a leading edge of the filament thereon, means for rotating said start-up roller such that said filament will wind itself upon said start-up roller from said further portion to said larger circumferential portion, said start-up roller being located such that the filament, when passing from said further portion to said larger circumferential portion, passes between the pair of spaced-apart rotatable rollers and contacts the yarn forming material, and cutting means positioned in the path of said filament to cut said filament after the filament has been placed in contact with the yarn forming material.

2. The apparatus of claim 1, wherein said start-up roller is of a frusto-conical configuration having a narrower inwardly tapered end and a wider outwardly tapered end.

3. The apparatus of claim 1, wherein said extruder means includes means for extruding a plurality of filaments of inter-fiber binding material.

4. The apparatus of claim 1, wherein said extruder means includes means for extruding a plurality of polymeric filaments.

5. The apparatus of claim 1, wherein said start-up roller includes means for securing to said smaller circumferential portion the filament extruded from said extrusion means.

6. The apparatus of claim 1, wherein said means for rotating said start-up roller includes means of operating said start-up roller at a peripheral speed equal to the peripheral speed of said pair of rotatable rollers plus or minus 20%.

7. The apparatus of claim 1, additionally comprising air jet means and disposal means, said air jet means adapted to divert said filament of inter-fiber binding material to said disposal means when said filament is not required for forming the composite yarn.

8. The apparatus of claim 1, wherein said apparatus includes leader means, said leader means adpated to supply a leader to the collecting means, further cutting means, said further cutting means adapted to cut said leader when desired.

9. The apparatus of claim 1, wherein said cutting means are automatic cutting means, said automatic cutting means being positioned so as to cut said filament automatically after said filament has been placed in juxtaposition to said collecting means.

10. The apparatus of claim 2, wherein said start-up roller includes means for securing a filament to the narrower tapered end, said means comprising a plate-like member secured thereto, said member extending beyond the circumferential edge of said narrow end, said member being mounted in a slight spaced-apart relationship with said narrower tapered end.

11. The apparatus of claim 10, wherein said securing means comprises a flexible member attached to the narrow end of said start-up roller.

12. The apparatus of claim 7, wherein said air jet means comprises a nozzle having an inlet connected to a pressurized source of air, a venturi in said nozzle, said venturi being connected to a discharge tube whereby when said pressurized air is supplied to said nozzle, a vacuum is created.

13. A method suitable for the introduction of a filament of inter-fiber binding material in an apparatus for the manufacture of composite yarn having at least two spaced-apart rotatable rollers, one of which has a collecting means for forming a layer of yarn-forming material from a source thereof, the method comprising the steps of providing an extrusion means adapted to extrude at least one filament of inter-fiber binding material, mounting said extrusion means on one side of the two spaced-apart rotatable rollers, providing a start-up roller on a side of said two spaced-apart rollers opposed to the side on which said extrusion means are mounted, said start-up roller having a portion of its circumference larger than a further circumferential portion, extruding a filament of inter-fiber binding material from said extrusion means, placing a leading edge of said filament on said further circumferential portion of said start-up roller, rotating said start-up roller, allowing said filament to wind upon said start-up roller towards said larger circumferential portion until it passes between the two spaced-apart rotatable rollers, and cutting said filament when the filament contacts the yarn-forming material on the collecting means.

14. An apparatus suitable for the manufacture of a composite yarn, said apparatus comprising at least first and second spaced-apart rotatable rollers, one of said rollers having a circumferentially extended collecting trough to receive a plurality of fibers, extrusion means adapted to supply at least one filament of a tacky polymeric material, said extrusion means being mounted above a plane extending between the axes of said pair of spaced-apart rollers, and a rotatable start-up roller, means for rotating said start-up roller, said start-up roller being mounted below the plane extending between the axes of said pair of spaced-apart rollers, said start-up roller having a portion of its circumference larger than a further circumferential portion, said further circumferential portion having means associated therewith to receive a leading edge of said filament, said start-up roller being operatively positioned with respect to said pair of spaced-apart rollers and said extrusion means such that said filament, when extending between said further circumferential portion and said extrusion means does not contact either of said spaced-apart rollers and when said start-up roller is rotatably driven, said filament winds itself upon said start-up roller from said further circumferential portion to said larger circumferential portion and, in a straight line condition, passes between said pair of spaced-apart rollers and contacts said fibers on said collecting trough, and cutting means operatively positioned in the path of said filament as said filament winds itself on said start-up roller such that said filament is automatically cut when the filament reaches a position of contact with said fibers.

* * * * *